US011100802B2

(12) United States Patent
Moncomble

(10) Patent No.: US 11,100,802 B2
(45) Date of Patent: Aug. 24, 2021

(54) METHOD FOR SIGNALING A SUGGESTION OF A BEHAVIOR TO A VEHICLE IN A TRAFFIC LANE AND ASSOCIATED TERMINAL

(71) Applicant: ORANGE, Issy-les-Moulineaux (FR)

(72) Inventor: Ghislain Moncomble, Chatillon (FR)

(73) Assignee: Orange, Issy-les-Moulineaux (FR)

( * ) Notice: Subject to any disclaimer, the term of this patent is extended or adjusted under 35 U.S.C. 154(b) by 0 days.

(21) Appl. No.: 16/627,126

(22) PCT Filed: Jun. 22, 2018

(86) PCT No.: PCT/FR2018/051526

§ 371 (c)(1),
(2) Date: Dec. 27, 2019

(87) PCT Pub. No.: WO2019/002734

PCT Pub. Date: Jan. 3, 2019

(65) Prior Publication Data

US 2020/0152063 A1 May 14, 2020

(30) Foreign Application Priority Data

Jun. 30, 2017 (FR) ..... 1756136

(51) Int. Cl.
*G08G 1/0965* (2006.01)
*G08G 1/16* (2006.01)

(52) U.S. Cl.
CPC ..... *G08G 1/162* (2013.01); *G08G 1/0965* (2013.01); *G08G 1/166* (2013.01)

(58) Field of Classification Search
None
See application file for complete search history.

(56) References Cited

U.S. PATENT DOCUMENTS

2016/0275796 A1* 9/2016 Kim ..... G08G 1/166
2016/0332570 A1* 11/2016 Kunkel ..... G08G 1/166
2016/0364621 A1 12/2016 Hill et al.
2018/0261098 A1* 9/2018 Gupta ..... G08G 1/164

OTHER PUBLICATIONS

English translation of the Written Opinion of the International Searching Authority dated Sep. 24, 2018 for corresponding International Application No. PCT/FR2018/051526, filed Jun. 22, 2018.

(Continued)

*Primary Examiner* — John F Mortell
(74) *Attorney, Agent, or Firm* — David D. Brush; Westman, Champlin & Koehler, P.A.

(57) ABSTRACT

A method for signaling a suggestion of a behavior, implemented by a signaling system. The method includes: determining an arrival of a first vehicle at a portion of a traffic route, there being a possibility of a second vehicle crossing paths with the first vehicle at the portion; determining an arrival of the second vehicle at the portion; determining a suggestion of a behavior of the second vehicle at the portion; sending a signal of the suggestion to the second vehicle; and receiving a notification that the signal has been taken into account by the second vehicle.

11 Claims, 4 Drawing Sheets

(56) References Cited

OTHER PUBLICATIONS

International Search Report dated Sep. 17, 2018 for corresponding International Application No. PCT/FR2018/051526, filed Jun. 22, 2018.
Written Opinion of the International Searching Authority dated Sep. 24, 2018 for corresponding International Application No. PCT/FR2018/051526, filed Jun. 22, 2018.
Li Li et al., "Cooperative Driving at Blind Crossings Using Intervehicle Communication", IEEE Transactions on Vehicular Technology, IEEE Service Center, Piscataway, NJ, US, vol. 55, No. 6, Nov. 1, 2006 (Nov. 1, 2006), pp. 1712-1724, XP011150381.
Morioka Y et al., "An Anti-Carcollision System Using GPS and 5.8GHZ Inter-Vehicle Communication at an Off-Sight Intersection", VTC 2000—Fall, IEEE VTS 52nd, Vehicular Technology Conference, Boston, MA, Sep. 24-28, 2000; [IEEE Vehicular Technolgy Conference], New York, NY, IEEE, US, vol. Conf. 52, Sep. 24, 2000 (Sep. 24, 2000), pp. 2019-2024, XP000988380.
Shirazi, Mohammad Shokrolah et al., "Looking at Intersections: A Survey of Intersection Monitoring, Behavior and Safety Analysis of Recent Studies", IEEE Transactions on Intelligent Transportation Systems, IEEE, Piscataway, NJ, USA, vol. 18, No. 1, Jan. 1, 2017 (Jan. 1, 2017), pp. 4-24, XP011637613.
Rola Naja, "Wireless Vehicular Networks for Car Collision Avoidance" In: "Wireless Vehicular Networks for Car Collision Avoidance", Jan. 1, 2013 (Jan. 1, 2013), Springer, XP055468776.

* cited by examiner

METHOD FOR SIGNALING A SUGGESTION OF A BEHAVIOR TO A VEHICLE IN A TRAFFIC LANE AND ASSOCIATED TERMINAL

CROSS-REFERENCE TO RELATED APPLICATIONS

This Application is a Section 371 National Stage Application of International Application No. PCT/FR2018/051526, filed Jun. 22, 2018, which is incorporated by reference in its entirety and published as WO 2019/002734 A1 on Jan. 3, 2019, not in English.

BACKGROUND OF THE INVENTION

The present invention relates to the field of autonomous vehicles and driver assistance, and more particularly relates to a technique of signaling a suggestion of behavior.

In a known manner, some motor vehicles are equipped with systems making it possible to assist the drivers of these vehicles when they drive these vehicles.

For example, document US 2016/0364621 describes a first motor vehicle equipped with a camera and able to analyze the images transmitted by the camera in order to detect a second vehicle and to calculate a distance separating the two vehicles. When the calculated distance is less than a threshold, the first vehicle then alerts its driver.

However, the system described by this document may prove to be insufficient in complex driving situations such as a vehicle overtaking or an arrival on an intersection, for example a roundabout.

OBJECT AND SUMMARY OF THE INVENTION

The present invention relates to a method for signaling a suggestion of a behavior, implemented by a signaling system, comprising the following steps:

- determining an arrival of a first vehicle on a portion of a traffic lane, a second vehicle being able to cross the first vehicle on the portion,
- determining an arrival of the second vehicle on the portion,
- determining a suggestion of a behavior of the second vehicle at the portion, and sending to the second vehicle a signaling of the suggestion.

The signaling method according to the invention allows greater consideration of the vehicles able to cross the first vehicle and thus likely to collide with the first vehicle, by automatically determining their presences and by signaling a behavior suggestion thereto.

The second vehicle can adapt its behavior according to the signaling sent, which improves the comfort and safety of the occupants of the first and second vehicles.

In one particular embodiment, the method further includes a step of determining the right-of-way between the first vehicle and the second vehicle at the portion, the suggestion being determined and the signaling being sent if the first vehicle has the right-of-way.

In one particular embodiment, the method further comprises a step of receiving a notification of the signaling having been taken into consideration by the second vehicle.

The notification of the signaling having been taken into consideration makes it possible to inform the first vehicle of the reaction of the second vehicle following the signaling of the behavior suggestion. The first vehicle can then adapt its behavior according to the notification, which also improves the comfort and safety of the occupants of the first and second vehicles.

In one particular embodiment, the notification of the signaling having been taken into consideration by the second vehicle comprises an indication concerning an action performed at the second vehicle. This action can be performed by the signaling system, another system being on-board the second vehicle and/or the driver being on-board the second vehicle.

In one particular embodiment, the step of determining an arrival of the first vehicle comprises a sub-step belonging to the group comprising the following sub-steps:

- determining a value corresponding to a duration relating to the first vehicle and to the portion, determining a value corresponding to a path of the first vehicle on the portion,
- the value being then taken into consideration, with configuration rules, in the step of determining the suggestion of the behavior.

In one particular embodiment, the method further comprises a step of communicating the signaling to the driver of the first vehicle.

Thus, the driver of the first vehicle is informed of his arrival on a risk area and of the presence of the second vehicle, which increases the vigilance of the driver of the first vehicle and thus improves the safety of the occupants of the first and second vehicles. He is also notified of the behavior suggestion sent to the second vehicle, and can thus manually cancel or modify the suggestion if necessary.

In one particular embodiment, the signaling is an electromagnetic signal out of the visible spectrum.

In one particular embodiment, the signaling is a signaling message sent via a telecommunications network.

In one particular embodiment, the step of sending to the second vehicle the signaling of the suggestion comprises a sub-step of identifying the second vehicle by means of a network identifier, the signaling being sent to the second vehicle identified.

In one particular embodiment, the portion is an intersection of the lane with another traffic lane.

In one particular embodiment, the portion is a portion of lane used by the first vehicle to overtake a third vehicle.

The invention further relates to a terminal able to implement a signaling method as described above.

In one particular embodiment, the various steps of the signaling method according to the invention are determined by computer program instructions.

Accordingly, the invention also relates to a computer program, on an information medium, this program including instructions adapted to the implementation of the steps of a signaling method according to the invention.

This program can use any programming language, and be in the form of source code, object code, or intermediate code between source code and object code, such as in a partially compiled form, or in any other desirable form.

The invention also relates to a computer-readable information medium, and including instructions of a computer program as mentioned above.

The information medium may be any entity or device capable of storing the program. For example, the medium may include a storage means, such as a ROM, for example a CD ROM or a microelectronic circuit ROM, or a magnetic recording means, for example a hard disk.

On the other hand, the information medium may be a transmissible medium such as an electrical or optical signal, which may be conveyed via an electrical or optical cable, by radio or by other means. The program according to the invention can be particularly downloaded on an Internet-type network.

Alternatively, the information medium may be an integrated circuit in which the program is incorporated, the circuit being adapted to execute or to be used in the execution of the method in question.

The invention further relates to a system comprising at least two terminals, each terminal being able to implement the signaling method as described above.

BRIEF DESCRIPTION OF THE DRAWINGS

Other features and advantages of the present invention will become apparent from the description given below, with reference to the appended drawings which illustrate an exemplary embodiment without any limiting character. In the figures.

DETAILED DESCRIPTION OF SEVERAL EMBODIMENTS

The present invention relates to the field of autonomous vehicles and driver assistance.

The present invention relates more particularly to a method for signaling a behavior suggestion, implemented when a first vehicle A circulates on a traffic lane V1, V3 including a portion P on which the first vehicle A can cross a second vehicle B.

By "portion P on which the first vehicle A can cross a second vehicle B", is meant that the second vehicle B can circulate on said portion P in a direction and/or a sense different from the direction and/or sense of the first vehicle A, so that the path of the second vehicle B can intersect or meet the path of the vehicle A.

The traffic lane V1 is in one example a land traffic lane. The portion P is then typically an intersection between said traffic lane V1 and another traffic lane V2.

Figure 1:
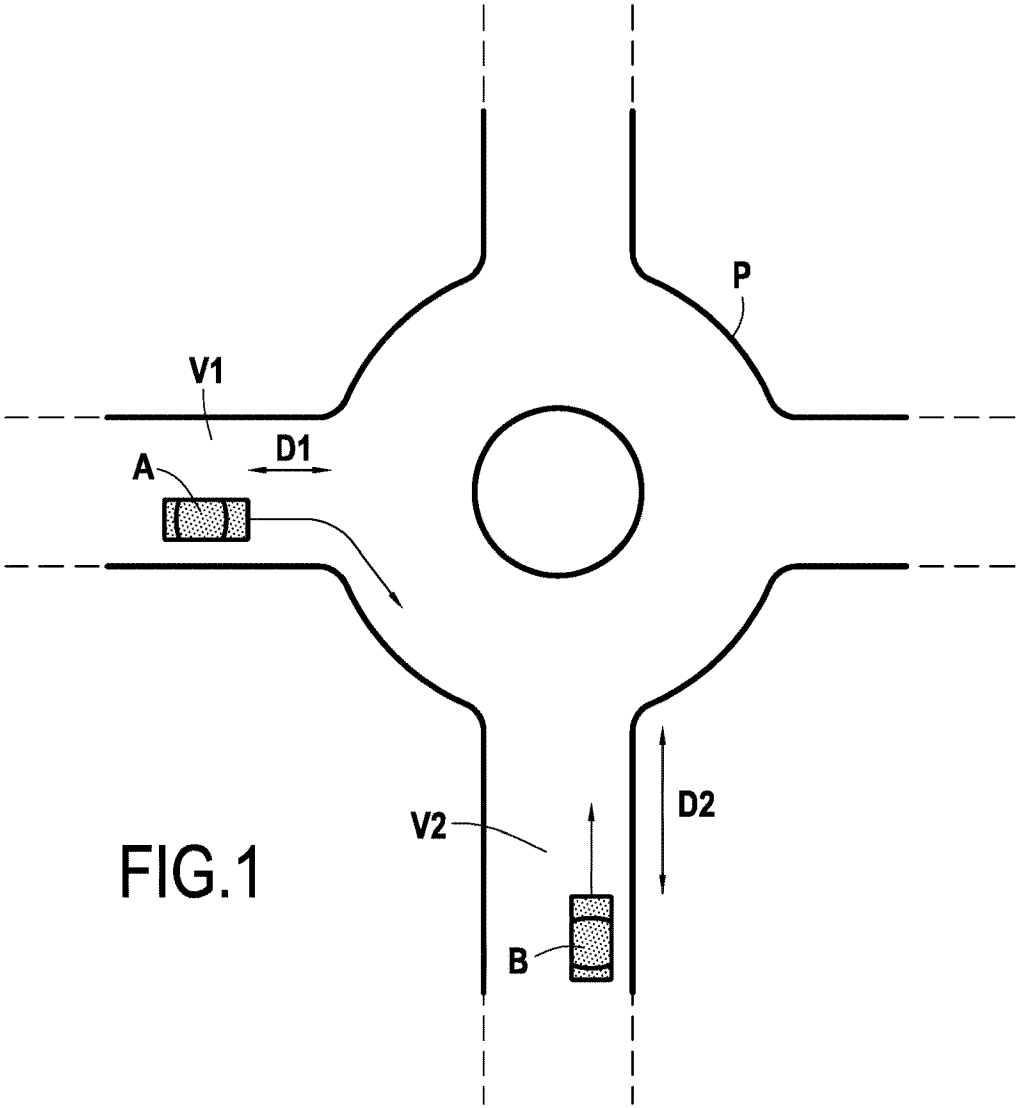

FIG. 1 schematically represents an intersection between said traffic lane V1 and another traffic lane V2, taking the form of a roundabout. Alternatively, the intersection may take the form of a crossing between said traffic lane V1 and the other traffic lane V2.

Figure 2:
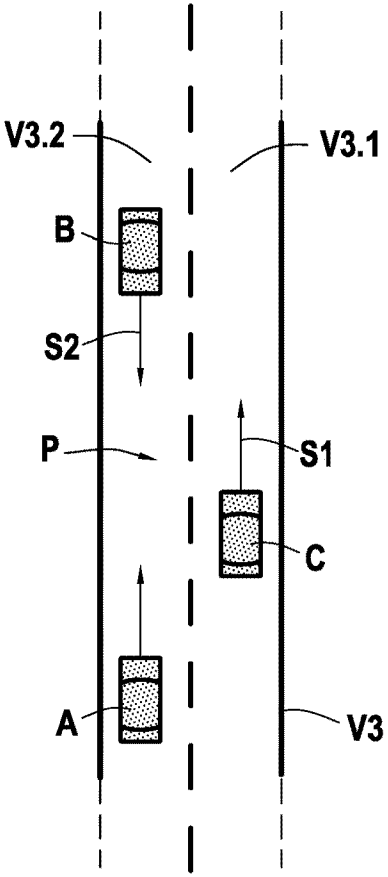
FIGS. 1 and 2 schematically represent portions of lanes on which the arrival of a first vehicle can be determined in a step of determining of a method for signaling a suggestion of a behavior according to examples of embodiments of the invention.

Alternatively, the portion P is a portion of lane used by the first vehicle A to overtake a third vehicle C, typically when the lane V3 includes two sub-lanes V3.1 and V3.2, a first sub-lane V3.1 being used in normal conditions by vehicles circulating in a first sense S1, and a second sub-lane V3.2 being used in normal conditions by vehicles circulating in a second sense S2 opposite to the first sense S1 (see FIG. 2).

Alternatively, the traffic lane V1, V3 is a maritime traffic lane, the vehicles then being boats.

Figure 3:
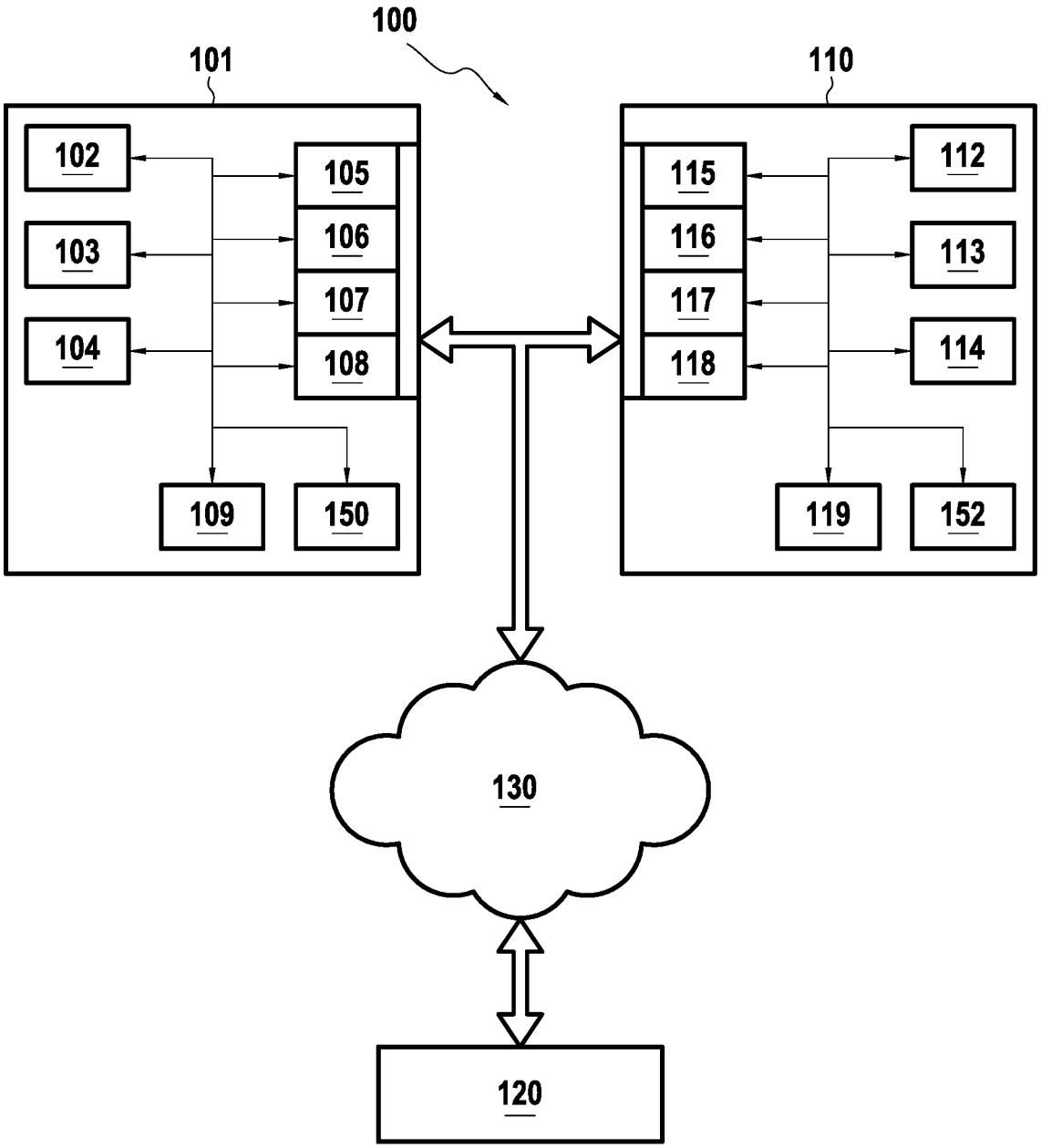
FIG. 3 schematically represents a system able to implement a method for signaling a suggestion of a behavior according to one exemplary embodiment of the invention.

FIG. 3 schematically represents a signaling system 100 able to implement a method for signaling a suggestion of a behavior according to one exemplary embodiment of the invention.

The signaling system 100 may include a first terminal 101, a second terminal 110 and/or a remote server 120.

The first terminal 101, the second terminal 110, and/or the server 120 may be connected to a telecommunications network 130 in order to communicate together. No limitation is attached to the nature of the telecommunications network. It can be for example a 3G, 4G network, etc.

The first terminal 101 is for example a terminal incorporated in the first vehicle A. The first terminal 101 may be alternatively a mobile terminal such as a mobile phone, for example of the "Smartphone" type, a touch tablet or a personal computer. In this variant, the first terminal 101 is positioned at the first vehicle A, typically inside the first vehicle A.

Similarly, the second terminal 110 is for example a terminal incorporated in the second vehicle B. The second terminal 110 may be alternatively a mobile terminal such as a mobile phone, for example of the "Smartphone" type, a touch tablet or a personal computer. In this variant, the second terminal 110 is positioned at the second vehicle B, typically inside the second vehicle B.

Figure 4A:
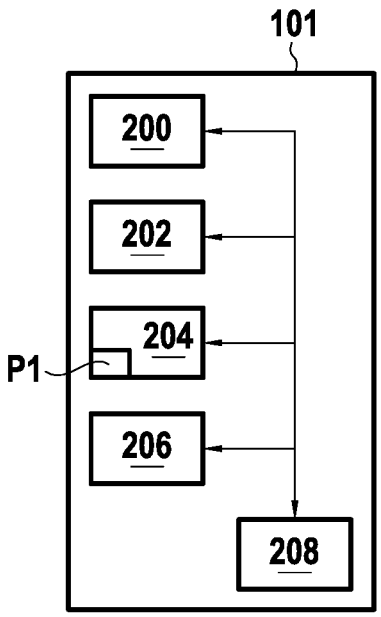
FIGS. 4A and 4B schematically represent, respectively, a first terminal and a second terminal of the system of FIG. 3.

As shown in FIG. 4A, the first terminal 101 has the conventional architecture of a computer. The first terminal 101 includes in particular a processor 200, a read-only memory 202 (of the "ROM" type), a rewritable non-volatile memory 204 (of the "EEPROM" or "flash NAND" type for example), a rewritable volatile memory 206 (of the "RAM" type), and a communication interface 208.

The read-only memory 202 of the first terminal 101 constitutes a recording medium according to one exemplary embodiment of the invention, readable by the processor 200 and on which is recorded a computer program P1 according to one exemplary embodiment of the invention. Alternatively, the computer program P1 is stored in the rewritable non-volatile memory 204.

This computer program P1 defines functional and software modules here, configured to implement the steps of a method for signaling a suggestion of a behavior, according to one exemplary embodiment of the invention. These functional modules rely on or control the hardware elements 200, 202, 204, 206 and 208 of the terminal 101 mentioned above. They comprise in particular here, as illustrated in FIG. 3, a first determining module 102, a second determining module 103, a third determining module 104, a first sending module 105, a first receiving module 106, a second receiving module 107, a second sending module 108 and/or a signaling module 109 and/or a fourth determining module 150.

The first determining module 102 includes a first determining sub-module, a second determining sub-module, a third determining sub-module, a fourth determining sub-module, a fifth determining sub-module (not represented).

Alternatively, the modules 102, 103, 104, 105, 106, 107, 108, 109, 150 and/or sub-modules are distributed between a third mobile terminal positioned at the first vehicle A, a fourth terminal incorporated in the first vehicle A, and/or one or more device(s) positioned at the first vehicle A such as an on-board camera and/or a GPS guidance means and/or the remote server 120.

The functions of these different modules are described in more detail below, with reference to the steps of the methods described with reference to FIGS. 5 and 6.

Figure 4B:
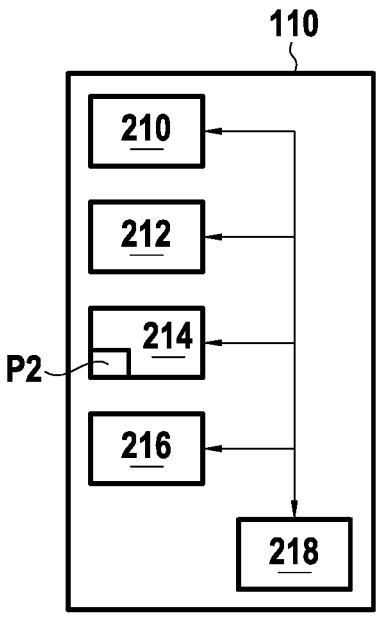

In addition, as shown in FIG. 4B, the second terminal 110 has the conventional architecture of a computer. The second terminal 110 includes in particular a processor 210, a read-only memory 212 (of the "ROM" type), a rewritable non-volatile memory 214 (of the "EEPROM" or "flash NAND" type for example), a rewritable volatile memory 216 (of the "RAM" type), and a communication interface 218.

The read-only memory 212 of the second terminal 110 constitutes a recording medium according to one exemplary embodiment of the invention, readable by the processor 210 and on which is recorded a second computer program P2 according to one exemplary embodiment of the invention. Alternatively, the second computer program P2 is stored in the rewritable non-volatile memory 204.

This second computer program P2 defines functional and software modules here, configured to implement the steps of a method for signaling a suggestion of a behavior, according to one exemplary embodiment of the invention. These functional modules rely on or control the hardware elements 200, 202, 204, 206 and 208 of the terminal 101 mentioned above. They comprise in particular here, as illustrated in FIG. 3, a first determining module 112, a second determining module 113, a third determining module 114, a first sending module 115, a first receiving module 116, a second receiving module 117, a second sending module 118, a signaling module 119 and/or a fourth determining module 152.

The first determining module 112 comprises a first determining sub-module, a second determining sub-module, a third determining sub-module, a fourth determining sub-module, a fifth determining sub-module (not represented).

As previously, alternatively, the modules 112, 113, 114, 115, 116, 117, 118, 152 and/or sub-modules are distributed between a fifth mobile terminal positioned at the second vehicle B, a sixth terminal incorporated in the second vehicle B, and/or one or more device(s) positioned at the second vehicle B such as an on-board camera and/or a GPS guidance means and/or the remote server 120.

Figure 5:
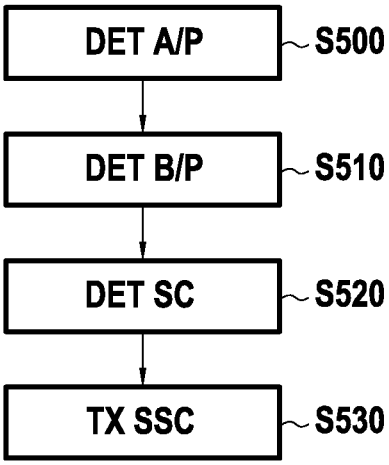
FIGS. 5 and 6 represent, in the form of flowcharts, the main steps of methods for signaling a suggestion of a behavior, according to exemplary embodiments of the invention.

FIG. 5 represents a method for signaling a suggestion of a behavior, according to one exemplary embodiment of the invention.

The method is implemented by a signaling system, for example the signaling system 100 described with reference to FIG. 3.

In one example, the signaling method is implemented by the first terminal 101 positioned at the first vehicle A, and/or the server 120.

In one step S500, an arrival of the first vehicle A, on a portion P of a traffic lane, is determined by the first determining module 102. Said portion P is a portion of lane on which a second vehicle B can cross the first vehicle A.

In one step S510, an arrival of the second vehicle B on said portion P is determined by the second determining module 103.

In one step S520, a suggestion SC of a behavior of the second vehicle B is determined by the third determining module 104.

In one step S530, a signaling SSC of said suggestion SC is sent to the second vehicle B by the first sending module 105.

The signaling method thus makes it possible to signal to the second vehicle B the suggestion SC of the behavior of the second vehicle B.

Figure 6:
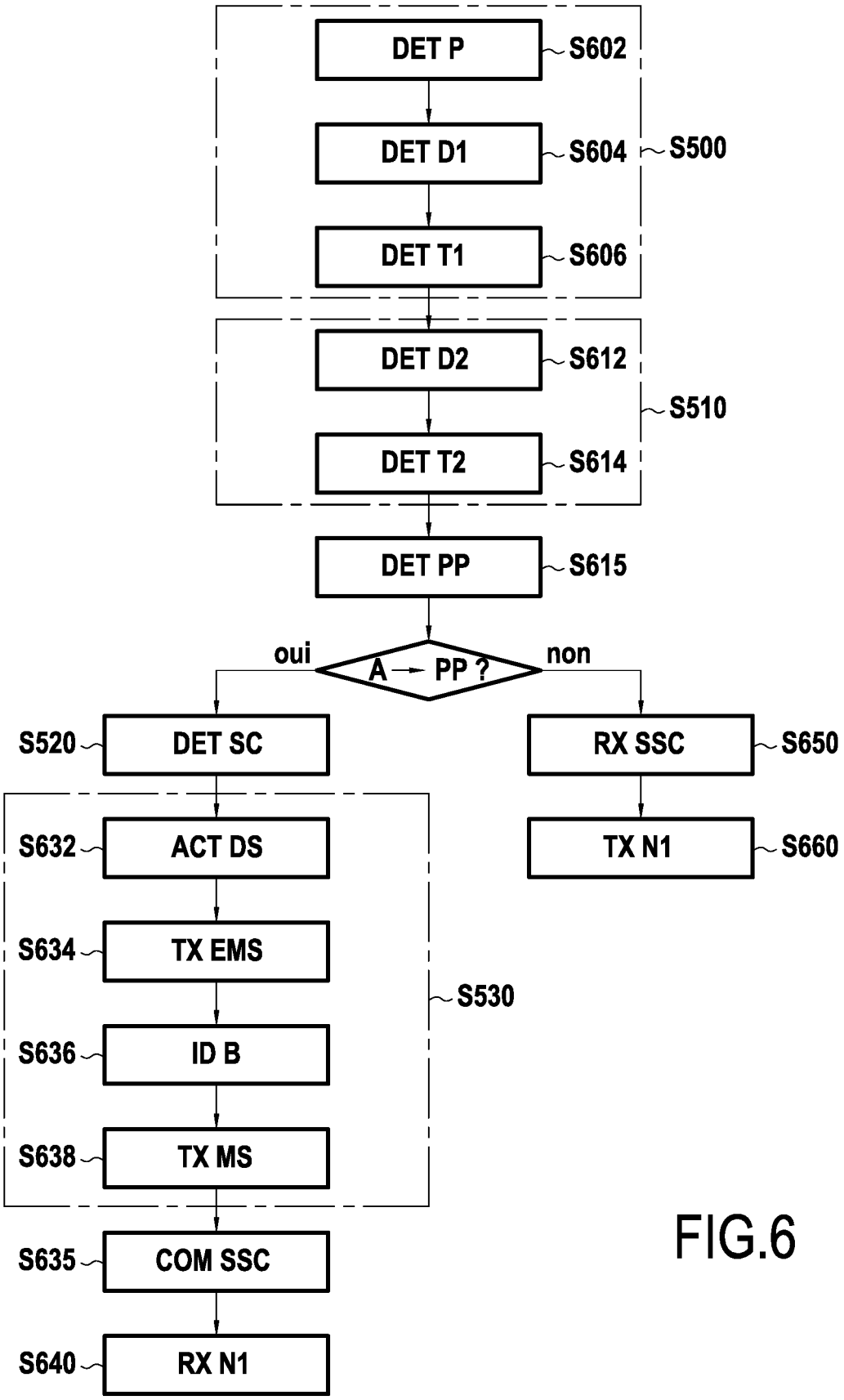

FIG. 6 represents a method for signaling a suggestion of a behavior, according to another exemplary embodiment of the invention.

The method is implemented by a signaling system, for example the signaling system 100 described with reference to FIG. 3.

In one example, the signaling method is implemented by the first terminal 101 positioned at the first vehicle A, and/or the server 120.

In one step S500, an arrival of the first vehicle A, on a portion P of the lane on which a second vehicle B can cross the first vehicle A, is determined by the first determining module 102.

This portion P of lane is a risk area, because the vehicles circulating in a different direction and/or sense are likely to collide with the first vehicle A.

The step S500 may comprise a first sub-step S602 of determining said portion P of lane, implemented by a first determining sub-module of the first determining module 102.

As indicated above, the first determining module 102 may be located at the first terminal 101 or at the remote server 120. Alternatively, the sub-modules of the first determining module 102 may be distributed between one or more localized terminal(s) at the first vehicle A (such as for example the first terminal 101), one or more device(s) positioned at the first vehicle A, and/or the remote server 120.

In one example, the portion P is determined based on the GPS coordinates of the first vehicle A, received by the first determining sub-module. More specifically, the GPS coordinates are compared to a road network map in order to determine whether the first vehicle A arrives to an intersection of lanes or on a lane where the vehicles can circulate in the opposite sense.

In another example that can be combined with the example above, the portion P is determined by analyzing at least one image transmitted by a camera, typically positioned on the first vehicle A.

In another example that can be combined with the above examples, the portion P is determined based on data relating to a command for changing the direction of the first vehicle A, typically from a sensor positioned at a steering member of the first vehicle A. The intention of the driver of the vehicle A to overtake a vehicle in front of him can thus be determined.

Then, in a sub-step S604 of the step S500, a value corresponding to a duration D1 relating to the first vehicle A and to said portion P can be determined by the first determining module 102.

When the portion P is an intersection of lanes, the duration D1 relating to the first vehicle A and to said portion P is the remaining duration before the arrival of the first vehicle A at the intersection.

In order to determine the remaining duration, the first determining module 102 can then take into consideration the following data:

- the remaining distance before the arrival of the first vehicle A at the intersection,
- the speed of the first vehicle A,
- the change of the speed of the first vehicle A,
- parameters relating to the first vehicle A such as the usual weight of the vehicle and/or the presence of an anti-lock brake system, these parameters being stored locally and possibly (the usual weight can be typically modified based on the measured rolling weight of the first vehicle A),
- a braking distance of the first vehicle A,
- and/or environmental data, such as outside temperature and/or outside humidity ratio.

Thus, a second determining sub-module of the first determining module 102 determines the remaining distance before the arrival of the first vehicle A at the intersection.

In one example, the remaining distance is determined from the GPS coordinates of the first vehicle A, compared to a road network map.

In another example that can be combined with the previous example, the remaining distance is determined by analyzing at least one image transmitted by a camera, typically positioned on the vehicle A.

In addition, a third determining sub-module of the first determining module 102 determines the speed of the first vehicle A, and possibly the change of the speed of the first vehicle A. The change of the speed makes it possible to determine whether the speed of the first vehicle A is constant, or whether the first vehicle A brakes or accelerates, as well as the intensity of braking or acceleration. The change of the speed due to a temporary braking of the first vehicle A with a view to the arrival of the first vehicle on the intersection can thus be determined.

In one example, the speed and/or the change of the speed are determined based on successive GPS coordinates of the first vehicle A.

In another example that can be combined with the example above, the speed and/or the change of the speed are determined by analyzing images transmitted by the camera.

In another example that can be combined with the above examples, the third determining sub-module can have access the speed data of the speedometer of the first vehicle VR.

In another example that can be combined with the above examples, the third determining sub-module consults an abacus to predict the change of the speed upon arrival of the first vehicle A at the intersection, from the determined speed.

The braking distance of the first vehicle A depends on the kinetic energy, calculated as a function of the weight of the first vehicle A and speed of the first vehicle A. In order to brake, the first vehicle A absorbs the kinetic energy by means of a braking power. The braking power depends on the type of the vehicle brake (disc brake, drum brake). In addition, an anti-lock brake system allows significantly reducing the braking distance. Indeed, the braking power decreases with time, due to the increase in temperature of the surfaces in contact (namely the brake and the wheel). An anti-lock brake system allows simulating a series of very fast braking operations, more effective than a continuous braking because the surfaces in contact heat up less quickly. In addition, the braking distance depends on the layout of the lane V1, V3 (straight or winding line).

In addition, a fourth determining sub-module of the first determining module 102 can determine one or more environmental data, such as the outside temperature and/or the outside humidity ratio. In one example, the data come from measuring devices positioned on the first vehicle A. In another example that can be combined with the previous example, the data are received by the fourth determining sub-module via the telecommunications network 130.

The environmental data allow determining a correction factor relating to the predictable slipping of the first vehicle A. Indeed, the braking distance increases by a predetermined percentage when the lane V1, V3 is wet or when the temperature of said lane V1, V3 is high. This percentage further changes according to the weight of the first vehicle A and speed of the first vehicle A. The correction percentage can then be applied to the value of the braking distance.

When the portion P is a sub-lane V3.2 used by the first vehicle A to overtake another vehicle C, the duration D1 relating to the first vehicle A and to said portion P is the duration for which the first vehicle A circulates on said sub-lane V3.2.

In order to determine the duration for which the first vehicle A circulates on said sub-lane, the first determining module 102 can then take into consideration the following data:

- the remaining distance before the first vehicle A leaves said sub-lane V3.2, that is to say before the first vehicle A returns to the normal circulation sub-lane V3.1,
- the speed of the first vehicle A,
- the change of the speed of the first vehicle A,
- speed parameters of the first vehicle A,
- parameters relating to the first vehicle A such as the usual weight of the vehicle, these parameters being locally stored and possibly modifiable in real time, typically according to the measured rolling weight of the first vehicle A,
- the speed of the third vehicle C, and a safety distance before and after the third vehicle C (the distance traveled by the first vehicle A on the portion P, namely the overtaking distance of the third vehicle C, depends indeed on the speed differential between the first vehicle A and the third vehicle C),
- and/or environmental data, such as outside temperature and/or outside humidity ratio.

Since these data can be determined in the same way as the data taken into consideration when the portion P is an intersection of lanes, their determination modes are not repeated here.

The sub-step S604 can be repeated one or several times, in order to follow in real time the change of the duration D1 relating to the first vehicle A and to the portion P.

In addition, a fifth determining sub-module of the first determining module 102 can determine, in a sub-step S606, a value corresponding to the planned path T1 of the first vehicle A at the portion P of lane, this path T1 being typically calculated at a GPS guidance device. The fifth determining sub-module of the first determining module 102 can thus determine the path T1 as a function of:

- the path calculated at a GPS guidance device,
- data relating to a command for changing the direction of the first vehicle A, and/or
- data relating to the intention of the driver of the vehicle A to change direction, typically data relating to the activation of a flashing light.

When the portion P is an intersection of lanes, the path determination T1 typically allows determining whether the first vehicle A will continue to advance on the same lane or whether the first vehicle A will use the intersection in order to change lane.

If the path T1 indicates that the first vehicle A will change lane, a device for signaling the first vehicle A, such as a flashing light or a buzzer, may be activated in order to warn any vehicles surrounding the first vehicle A.

The sub-step S606 can be repeated one or several times, in order to follow in real time the change in the planned path T1 of the first vehicle A at the portion P of lane.

Then, in a step S510, an arrival of the second vehicle B on said portion P is determined by a second determining module 103, the second determining module 103 can be located at the first terminal 101 or at the remote server 120.

In one example, the second determining module 103 can determine the arrival of the second vehicle B by analyzing one or more image(s) transmitted by one or more camera(s), for example a camera positioned on the first vehicle A and/or a camera positioned on a vehicle positioned in front of the first vehicle A, such as the third vehicle C. An image processing can thus be performed on one or more image(s) transmitted by the camera(s) in order to detect the second vehicle B.

The camera(s) typically allow(s) capturing images of the environment located in front of the first vehicle A, in order to detect vehicles arriving at the portion P in a sense and/or direction different from the sense and/or direction of the first vehicle A.

In another example that can be combined with the previous example, the second determining module 103 can determine the arrival of the second vehicle B from a received message sent by the second vehicle B via the telecommunications network 130.

Thus, the arrival of the second vehicle B can be determined even if the visibility of the second vehicle B from the first vehicle A is not ensured, typically when the second vehicle B arrives at an elevated intersection and/or at which the view is blocked by a wall.

In one example that can be combined with the previous example, an electromagnetic signal is sent by means of radar, typically positioned on the first vehicle A. The electromagnetic signal can then be reflected by the second vehicle B, and then the reflected signal is received by the radar.

The received signal is then analyzed by the second determining module 103 in order to determine the arrival of the second vehicle B.

In one example that can be combined with the previous examples, the arrival of the second vehicle B is determined by analyzing a LASER (Light Amplification by Stimulated Emission of Radiation) signal.

The second determining module 103 can further determine the speed of the second vehicle B, the change of the speed of the vehicle B, the type of vehicle of the second vehicle B, and/or a remaining distance relating to the portion P and to the second vehicle B.

These different data can be determined by image analysis. The weight of the second vehicle B can further be deduced from the determined type of vehicle, for example by consultation of a table indicating the weight of one or more type(s) of vehicle.

Alternatively, these different data are determined from the received message, the received electromagnetic signal and/or the LASER signal.

The second determining module 103 can then determine, in a sub-step S612, a duration D2 relating to the second vehicle B and to the portion P from several of the aforementioned data. The environmental data, possibly determined in the sub-step S604, can further be used to calculate said duration D2. The environmental data of the second vehicle B are indeed considered to be identical to the environmental data of the first vehicle A.

When the portion P is an intersection of lanes, the duration D2 relating to the second vehicle B and to said portion P is the remaining duration before the arrival of the second vehicle B at the intersection, and the remaining distance relating to the second vehicle B and to the portion P is the remaining distance before the arrival of the second vehicle B at the intersection.

When the portion P is a sub-lane used by the first vehicle A to overtake another vehicle C, the duration D2 relating to the second vehicle B and to said portion P is the remaining duration before the arrival of the second vehicle B at the third vehicle C.

Alternatively, the arrival of several second vehicles can be determined in the step S510 by the second determining module 103.

The first vehicle A is thus informed in real time of the arrival of the second vehicle B on the portion P of lane as part of a risk period. The risk period comprises at least the duration D1 relating to the first vehicle A and to the portion P, to which an additional duration may be added. During this risk period, which typically lasts a few seconds, the first vehicle A and the second vehicle B are likely to collide.

The detection of the arrival of the second vehicle B on the portion P of lane may allow a first consideration of the second vehicle B by the first vehicle A and/or its driver, and first decisions in driving the first vehicle A.

The sub-step S612 may be repeated one or several times, in order to follow in real time the change of the duration D2 relating to the second vehicle B and to the portion P.

The second determining module 103 can also determine, in a sub-step S614, a planned path T2 of the second vehicle B at the portion P of lane. The path T2 can be determined by analyzing the images transmitted by the camera(s), typically by determining an angle of orientation of a drive wheel of the second vehicle B or by detecting a discontinuous light emission from a flashing light of the second vehicle B.

Alternatively, the path T2 can be determined from a received message sent by the second vehicle B via the telecommunications network 130.

The sub-step S614 can be repeated one or several times, in order to follow in real time the change in the planned path T2 of the second vehicle B. A change in the path T2 of the second vehicle B can thus be determined.

Alternatively, the planned path T2 of at least another vehicle can be determined in the step S614 by the second determining module 103.

In a step S615, the right-of-way PP between the first vehicle A and the second vehicle B, at the portion P, can be determined by a fourth determining module 150, the fourth determining module 150 being localizable at the first terminal 101 or at the remote server 120.

In order to determine the right-of-way PP, the third determining module 104 takes into consideration configuration rules, such as predefined road or maritime traffic rules. The predefined road traffic rules comprise the usual rules of the Highway Code and/or predefined rules relating to the portion P of lane. The predefined maritime traffic rules comprise common rules such as the right-of-way of a sailboat over a motorboat.

When the portion P is an intersection of lanes and if there is no predefined rule relating to the portion P, the usual rules of the Highway Code are applied by the third determining module 104. For example, in France, the right-of-way is given to the vehicles arriving on the right, except for the roundabouts, where the right-of-way is given to the vehicles arriving on the left. The predefined rules relating to the portion P of lane may comprise for example an obligation to give way to the vehicles of another lane.

When the portion P is a sub-lane used by the first vehicle A to overtake the third vehicle C, according to the usual rules of the Highway Code, the second vehicle B has always the right-of-way, except in the specific case of some types of emergency vehicles duly signaled (for example a firemen car), because this sub-lane is the normal traffic sub-lane for the vehicle B while it is not for the vehicle A.

The third determining module 104 can take into consideration, in addition to the predefined road traffic rules, the duration D1 relating to the first vehicle A and to the portion P, the duration D2 relating to the first vehicle B and to the portion P, the planned path T1 of the first vehicle A and/or the planned path T2 of the second vehicle B.

For example, if the predefined road traffic rules give the right-of-way to the first vehicle A but it is estimated that the second vehicle B has time to leave the portion P without interfering with the first vehicle A (for example if the second vehicle B arrives at an intersection well before the first vehicle A so that the first vehicle A does not have to slow down), the third determining module 104 determines that the second vehicle B has the right-of-way PP. On the other hand, if the second vehicle B does not have time to leave the portion P without interfering with the first vehicle A, the third determining module 104 determines that the first vehicle A has the right-of-way PP.

The step S615 can be repeated one or several times. In addition, the right-of-way PP between the first vehicle A and at least another vehicle different from the second vehicle B can be determined in the step S615.

If the first vehicle A has the right-of-way, a suggestion SC of a behavior of the second vehicle B at the portion P is determined by the third determining module 104 (step S520).

More specifically, when the portion P is an intersection of lanes, if the first vehicle A has the right-of-way, and if the planned path T2 of the second vehicle B at the portion P of lane, determined in the sub-step S614, intersects the planned path T1 of the first vehicle A, determined in the sub-step S606, the suggestion SC comprises for example a suggestion to reduce the speed of the second vehicle B (thus a suggestion to brake), typically coupled to a suggestion of speed reduction intensity. The suggestion SC may further comprise a suggestion to give way to the first vehicle A.

In addition, when the portion P is an intersection of lanes, if the first vehicle A has the right of-way, and if the planned path T2 of the second vehicle B at the portion P of lane does not intersect the planned path T1 of the first vehicle A, the suggestion SC comprises for example a suggestion to maintain the speed of the vehicle B. The suggestion SC may further comprise a suggestion not to take into consideration the first vehicle A.

In one example where the second vehicle B is an autonomous or semi-autonomous vehicle, the suggestion SC can be automatically followed by means for controlling and driving the second vehicle B.

If the first vehicle A has the right-of-way, a signaling SSC of said suggestion SC is sent to the second vehicle B (step S530) by a sending module 105, the sending module 105 can be located at the first terminal 101 or at the remote server level 120.

The sent signaling SSC allows informing the second vehicle B of the presence of the first vehicle A, the right-of-way PP of the first vehicle A and the behavior to have, even if the driver of the first vehicle A fails to activate a signaling device such as a flashing light of the first vehicle A. The second vehicle B can then adapt its behavior according to this signaling SSC, which improves the comfort and safety of the occupants of the first and second vehicles.

The step S530 of sending the signaling SSC may comprise a sub-step S632 of activating at least one signaling device DS of the first vehicle A, for example in the case where said signaling device DS of the first vehicle A has not already been activated in the sub-step S606. The signaling device DS may be a flashing light, a buzzer, etc.

The signaling SSC can thus be a light signal, for example emitted by a flashing light, and/or a sound signal.

In addition, the step S530 of sending the signaling SSC may comprise a sub-step S634 of sending a signaling SSC taking the form of an electromagnetic signal EMS out of the visible spectrum, typically encoded. The electromagnetic signal EMS is for example an infrared signal, or an ultraviolet signal.

In addition, the step S530 of sending the signaling SSC may comprise a sub-step S638 of sending a signaling SSC taking the form of a signaling message MS. The signaling message MS is sent via a telecommunications network, typically the network 130.

When the sending module 105 is located at the remote server 120, the sending of the message can be a sending in notification mode (push mode).

In this example, the sending step S530 comprises, prior to the sub-step S638, a sub-step S636 of identifying the second vehicle B, so that the signaling SSC is sent to the second vehicle B identified. The identification can be made by means of:

- a network identifier,
- at least one geolocation position, and/or
- data relating to the second vehicle B, such as the type of vehicle or a license plate number.

More specifically, the sending module 105 obtains one or more geolocation position(s) of the vehicle B, then obtains the network identifier of the second vehicle B from the location position(s) obtained.

In one example, the second terminal 110 of the second vehicle B regularly sends its location position to a remote server. The sending module 105 can obtain the last geolocation position of the second vehicle B sent by consulting the remote server, the last location position being found by means of the geolocation position of the first vehicle A and the geolocation position of the portion P.

The network identifier is for example the MSISDN (Mobile Station Integrated Services Digital Network) number. The identification can be ensured by a security device, for example a SIM card, of the second terminal 110 of the second vehicle B.

The data relating to the second vehicle B can also be used to confirm the identity of the second vehicle B.

The consideration of several data makes it possible to accurately identify the second vehicle B, and thus to reduce the risk of getting the wrong recipient when sending the signaling SSC.

In case of doubt on the identity of the second vehicle B, for example when the second vehicle B is closely followed by one or more vehicle(s) so that the geolocation position(s) do not allow identifying the second vehicle B with certainty, the network identifiers of all the vehicles that can correspond to the geolocation position(s) are obtained in the sub-step S636, and the signaling message MS is then sent to all the vehicles in the sub-step S638.

As before, the step S530 can be repeated one or several times for the second vehicle B and/or at least another vehicle.

In a step S635, if the first vehicle A has the right-of-way, the signaling module 119 can communicate the signaling SSC to the driver of the first vehicle A.

Thus, the driver of the first vehicle A is informed of his arrival on a risk area and on the presence of the second vehicle B, which increases the vigilance of the driver of the first vehicle A and thus enhances the safety of the occupants of the first and second vehicles.

The signaling SSC corresponds for example to the emission of a signaling image or sound, such as a sound corresponding to the activation of a flashing light.

The driver of the first vehicle A may furthermore take into consideration the content of the signaling SSC. Thus, the signaling SSC may allow the driver of the first vehicle to cancel the sending of the signaling SSC to the second vehicle B, performed in the step S530.

For example, the driver can provide a path of the first vehicle different from the path provided by the GPS guidance device of the first vehicle A. The signaling SSC then makes it possible to inform the driver that a bad suggestion is sent to the second vehicle B, and can thus manually cancel or modify the suggestion SC. Such a modification of signaling SSC is typically subject to time and safe distance constraints, beyond which the driver of the first vehicle A cannot modify the suggestion SC, the signaling system 100 possibly storing a history of the signaling sent. A signaling of the modified suggestion is then sent to the second vehicle B.

The method may comprise, if the first vehicle A has the right-of-way, a step S640 of receiving a notification N1 of said signaling SSC having been taken into consideration by the second vehicle B.

More specifically, the receiving module 106 receives a notification N1 of the signaling SSC having been taken into consideration, sent by the second vehicle B.

The notification N1 for taking consideration the signaling SSC makes it possible to inform the first vehicle A of the receipt of the signaling SSC by the second vehicle B.

In the same way as for the signaling SSC sent in the step S630, the notification N1 may be a light signal, for example emitted by at least one signaling device of the second vehicle B, such as a flashing light, and/or a sound signal.

In addition, the notification N1 may take the form of an electromagnetic signal out of the visible spectrum, typically encoded.

In addition, the notification N1 can take the form of a message, sent via a telecommunications network, typically the network 130.

Before sending the message, the second vehicle B, or more specifically the second terminal 110 must thus identify the first vehicle A. This identification is for example performed in the same way as in the identification sub-step S636. Alternatively, the network identifier of the first vehicle A is sent, in the step S632, to the second vehicle B in the signaling message.

The notification N1 of said signaling SSC having been taken into consideration by the second vehicle B may comprise an indication concerning an action performed at the second vehicle B.

By "action performed at the second vehicle B" is meant a decision and/or an adaptation performed at the second vehicle B.

The decision may be an acceptance and an adoption of the suggestion SC determined in the step S520, or a refusal to follow said suggestion SC.

The notification N1 of the signaling SSC having been taken into consideration then allows informing the first vehicle A of the reaction of the second vehicle B following the signaling SSC of the suggestion SC of behavior. The first vehicle A can then adapt its behavior according to the notification N1, which also improves the comfort and safety of the occupants of the first and second vehicles.

As previously, the step S640 can be repeated one or several times, the notification N1 being received from the second vehicle B and/or at least another vehicle.

Alternatively, no notification of said signaling SSC having been taken into consideration is received. The first vehicle A is then informed that the second vehicle B is not able to send such notifications and may not be able to process the signaling SSC sent. The first vehicle A can then adapt its driving behavior.

Alternatively, the step S615 is not implemented and the suggestion SC is determined (step S520) then the signaling SSC sent (step S530) even if the first vehicle A does not have the right-of-way. The steps S635 and S640 can therefore also be implemented even if the first vehicle A does not have the right-of-way.

If the second vehicle B is equipped with the second terminal 110, the modules 112, 113, 152 and/or 114 of the second terminal 110 can also respectively implement the steps S500, S510, S615 and/or S520 of the method for signaling a suggestion of a behavior, in the same way as the modules 102, 103, 104 of the first terminal 101 (the concepts of first vehicle A and second vehicle B being however reversed). Alternatively, the steps S500, S510, S615 and S520 of the method for signaling a suggestion of a behavior are implemented by the server 120.

Thus, if the second vehicle B has the right-of-way, the first sending module 115 of the second terminal 110 or of the server 120 can implement the step S530 by sending a signaling of the suggestion of the behavior from the first vehicle A to the first vehicle A.

The second receiving module 107 of the first terminal 101 then receives the signaling in a step S650, then the second sending module 108 of the first terminal 101 can send, in a step S660, a notification of the signaling having been taken into consideration to the second vehicle B.

When the portion P is a sub-lane used for the first vehicle A to overtake another vehicle C, the suggestion is for example a suggestion to move back the first vehicle A to the normal traffic lane of the first vehicle A and/or a suggestion to increase or reduce the speed of the first vehicle A (thus a suggestion to brake or accelerate), typically coupled to a suggestion of speed increase or speed reduction intensity.

The first receiving module 116 of the second terminal 110 then receives the notification of the signaling having been taken into consideration (step S640).

The invention claimed is:

1. A signaling method for signaling a suggestion of a behavior, implemented by a signaling system, wherein the method comprises the following acts:

determining an arrival of a first vehicle on a portion of a traffic lane, a second vehicle being able to cross the first vehicle on said portion, the portion being a sub-lane used by the first vehicle to overtake another vehicle, said determining an arrival of the first vehicle comprising determining a value corresponding to a duration for which the first vehicle circulates on said sub-lane, determining an arrival of the second vehicle on said portion, determining a suggestion of a behavior of the second vehicle at said portion based on said value and configuration rules, sending to the second vehicle a signaling of said suggestion, and receiving a notification of said signaling having been taken into consideration by the second vehicle.

2. The signaling method according to claim 1, further comprising an act of determining the right-of-way between the first vehicle and the second vehicle at the portion, the suggestion being determined and the signaling being sent in response to the first vehicle has the right-of-way.

3. The signaling method according to claim 1, wherein the notification of said signaling having been taken into consideration by the second vehicle comprises an indication concerning an action performed at the second vehicle.

4. The signaling method according to claim 1, wherein the act of determining an arrival of the first vehicle comprises determining a value corresponding to a path of the first vehicle on said portion, said value being then taken into consideration in the of determining the suggestion of the behavior.

5. The signaling method according to claim 1, further comprising an act of communicating the signaling to the driver of the first vehicle.

6. The signaling method according to claim 1, wherein the signaling is an electromagnetic signal out of the visible spectrum.

7. The signaling method according to claim 1, wherein the signaling is a signaling message sent via a telecommunications network.

8. The signaling method according to claim 7, wherein the act of sending to the second vehicle said signaling of the behavior suggestion comprises a sub-act of identifying the second vehicle, the signaling being sent to the second vehicle identified.

9. A terminal comprising:

a processor; and a non-transitory computer-readable medium comprising instructions stored thereon which when executed by the processor configure the terminal to perform act comprising:

signaling a suggestion of a behavior by:

determining an arrival of a first vehicle on a portion of a traffic lane, a second vehicle being able to cross the first vehicle on said portion, the portion being a sub-lane used by the first vehicle to overtake another vehicle, said determining an arrival of the first vehicle comprising determining a value corresponding to a duration for which the first vehicle circulates on said sub-lane, determining an arrival of the second vehicle on said portion, determining a suggestion of a behavior of the second vehicle at said portion based on said value and configuration rule, sending to the second vehicle a signaling of said suggestion, and receiving a notification of said signaling having been taken into consideration by the second vehicle.

10. A non-transitory computer-readable recording medium on which is recorded a computer program comprising instructions for execution of a signaling method when the instructions are executed by a processor of a device, wherein the instructions configure the device to:

signal a suggestion of a behavior by:

determining an arrival of a first vehicle on a portion of a traffic lane, a second vehicle being able to cross the first vehicle on said portion, the portion being a sub-lane used by the first vehicle to overtake another vehicle, said determining an arrival of the first vehicle comprising determining a value corresponding to a duration for which the first vehicle circulates on said sub-lane, determining an arrival of the second vehicle on said portion, determining a suggestion of a behavior of the second vehicle at said portion based on said value and configuration rule, sending to the second vehicle a signaling of said suggestion, and receiving a notification of said signaling having been taken into consideration by the second vehicle.

11. A system comprising at least two terminals, each terminal comprising:

a processor; and a non-transitory computer-readable medium comprising instructions stored thereon which when executed by the processor configure the terminal to perform act comprising:

signaling a suggestion of a behavior by:

determining an arrival of a first vehicle on a portion of a traffic lane, a second vehicle being able to cross the first vehicle on said portion, the portion being a sub-lane used by the first vehicle to overtake another vehicle, said determining an arrival of the first vehicle comprising determining a value corresponding to a duration for which the first vehicle circulates on said sub-lane, determining an arrival of the second vehicle on said portion, determining a suggestion of a behavior of the second vehicle at said portion based on said value and configuration rules, sending to the second vehicle a signaling of said suggestion, and receiving a notification of said signaling having been taken into consideration by the second vehicle.

* * * * *